US007258093B2

(12) United States Patent
Chriswell et al.

(10) Patent No.: US 7,258,093 B2
(45) Date of Patent: Aug. 21, 2007

(54) CONCAVE COMBUSTION CHAMBER

(76) Inventors: Shawn D. Chriswell, 2607 Stratford La., Longmont, CO (US) 80503; Darrell R. Chriswell, 5650 Boulder Hills Dr., Longmont, CO (US) 80503

( * ) Notice: Subject to any disclaimer, the term of this patent is extended or adjusted under 35 U.S.C. 154(b) by 0 days.

(21) Appl. No.: 11/291,710

(22) Filed: Dec. 1, 2005

(65) Prior Publication Data

US 2007/0125333 A1 Jun. 7, 2007

(51) Int. Cl.
*F02F 1/42* (2006.01)

(52) U.S. Cl. ..... 123/193.5

(58) Field of Classification Search ..... 123/193.5, 123/195 C, 295
See application file for complete search history.

(56) References Cited

U.S. PATENT DOCUMENTS 1,693,832 A * 12/1928 Vincent ..... 123/90.4
2,974,654 A 3/1961 Bouvy
3,948,229 A 4/1976 Abthoff et al.
3,949,724 A 4/1976 Nickly
4,082,068 A 4/1978 Hale
4,146,004 A 3/1979 DuBois
4,162,662 A * 7/1979 Melchior ..... 123/65 VD
4,401,067 A * 8/1983 Honda ..... 123/193.6
4,729,348 A 3/1988 Okada et al.
4,788,950 A * 12/1988 Finley ..... 123/195 C
4,879,980 A 11/1989 Piazzo
4,924,823 A 5/1990 Ogura et al.
4,986,249 A 1/1991 Nakamura
5,143,034 A 9/1992 Hirose
5,230,317 A * 7/1993 Nonogawa et al. ..... 123/432
5,335,634 A * 8/1994 Hashimoto et al. .... 123/188.14
5,351,663 A 10/1994 Makimura et al.
5,398,645 A 3/1995 Haman
5,868,113 A 2/1999 Yoshikawa
5,941,221 A 8/1999 Marocco et al.
5,983,849 A 11/1999 Wangen et al.
6,082,318 A * 7/2000 Malatto et al. ..... 123/193.5
6,098,583 A * 8/2000 Gordon ..... 123/90.38
6,199,544 B1 * 3/2001 Feuling ..... 123/661
6,213,072 B1 4/2001 Sayama et al.
6,435,153 B1 * 8/2002 McAliece et al. ..... 123/193.3
6,598,577 B1 7/2003 Marino
6,691,661 B2 2/2004 Lundgreen et al.
6,769,390 B2 8/2004 Hattori
6,920,869 B2 7/2005 Murata et al.
2003/0019459 A1 1/2003 Ohsawa
2003/0019467 A1 1/2003 Mengoli
2003/0140882 A1 7/2003 Lundgreen et al.

(Continued)

*Primary Examiner*—Marguerite McMahon
(74) *Attorney, Agent, or Firm*—Margaret Polson; Patent Law Offices of Rick Martin, PC

(57) ABSTRACT

An internal combustion engine is provided with a roughly concave cylinder head, wherein a ridge descends into the combustion chamber. A first wall is formed from the ridge to a cylinder periphery to form a seat for an air intake valve. A second wall is formed from the ridge to the opposite cylinder periphery to form a seat for one or more exhaust valves. The valves must criss-cross to open/close. The result is a more efficient flow of intake air and exhaust air to and from the combustion chamber which creates more horsepower. A plug compatible cylinder head can be installed on an engine to get added horsepower without a supercharger.

17 Claims, 9 Drawing Sheets

U.S. PATENT DOCUMENTS

2003/0154948 A1 8/2003 Hattori
2004/0194736 A1 10/2004 Brinton
2005/0011476 A1 1/2005 Murata et al.
2005/0011695 A1 1/2005 Murata et al.
2005/0139198 A1 6/2005 Park
2005/0178371 A1 8/2005 Sjovall et al.

* cited by examiner

CONCAVE COMBUSTION CHAMBER

FIELD OF INVENTION

The present invention relates to improving performance of an internal combustion engine by means of shaping the cylinder head to more efficiently intake and exhaust the combustion air.

BACKGROUND OF THE INVENTION

Historically many types of combustion heads have been designed including flat heads, hemispherical (hemi-see Japanese Patent Pub. No. 52-54820, published May 4, 1977) and smoothed. The smoothed combustion chamber is disclosed in U.S. Pat. No. 5,941,221 (1999) to Marocco et al. His chamber is radiused and smoothed in order to reduce the surface area relative to the volume of the combustion chamber. His theory for improved efficiency is to increase the average combustion temperature, thereby producing more efficient combustion.

Many efforts to improve engine efficiency (horsepower) by means of maximizing airflow velocity have been made. U.S. Pat. No. 6,691,661 (2004) to Lundgreen et al. discloses a tuned air induction apparatus for a V-twin motorcycle engine. Separate intake passages for each cylinder allegedly improve airflow velocity and horsepower.

Nobody has invented a concave cylinder head which provides a straighter and shorter air passage in and out of the combustion chamber. The present invention reduces the air friction around the intake and exhaust valves by providing a straighter passage into and out of the combustion chamber. Engine performance is measurably increased by simply replacing a cylinder head with the present invention.

SUMMARY OF THE INVENTION

An aspect of the present invention is to provide a less restrictive air inlet and outlet to and from a combustion chamber.

Another aspect of the present invention is to provide a concave cylinder head to form the air inlet and outlet.

Another aspect of the present invention is to provide a crisscrossed alignment of intake and exhaust valve stems to operate with the concave cylinder head.

Another aspect of the present invention is to provide a unique valve stem linage assembly to open and close the intake and exhaust valves.

Another aspect of the present invention is to use a dual concave cylinder head to separate the fresh intake air from the burnt exhaust air, thereby reducing the inefficient exhaust of unburnt intake air during the exhaust cycle.

Another aspect of the present invention is to provide a reduced time of flight of the combustion gases through a combustion chamber.

Another aspect of the present invention is to reduce unburnt combustion gases from being expelled during the exhaust cycle by using the dual concave cylinder head to form an intake air and an exhaust air segment in the combustion chamber.

Another aspect of the present invention is to provide an air efficient cylinder head assembly that is compatible with a prior art engine.

Other aspects of this invention will appear from the following description and appended claims, reference being made to the accompanying drawings forming a part of this specification wherein like reference characters designate corresponding parts in the several views.

The present invention provides and air intake passage in a cylinder head, wherein the intake air has a straight passage into the combustion chamber without having to deflect around the intake valve. This is accomplished by changing the axial alignment of the intake valve stem about 90° so that the valve body moves out of the way of a segment of the incoming air flow. The same 90° realignment of the exhaust valve stem is done. The valves seats are formed into a concave segment of the cylinder head which protrudes down into the combustion chamber. The volume of the combustion chamber can be defined by choosing a shim between the engine block and the new cylinder head.

The resulting design criss-crosses the valve stems. A new valve stem linkage assembly opens and closes the valves. The result is a faster ingress and egress of combustion air to and from the combustion chamber. Prototype tests on a motorcycle V-twin yielded about a 5-15% horsepower increase. Fuel economy has also been achieved.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

The term "concave" used herein means the cylinder head descends into the combustion chamber generally with a straight line segment that defines a wall that supports a valve.

Figure 1:
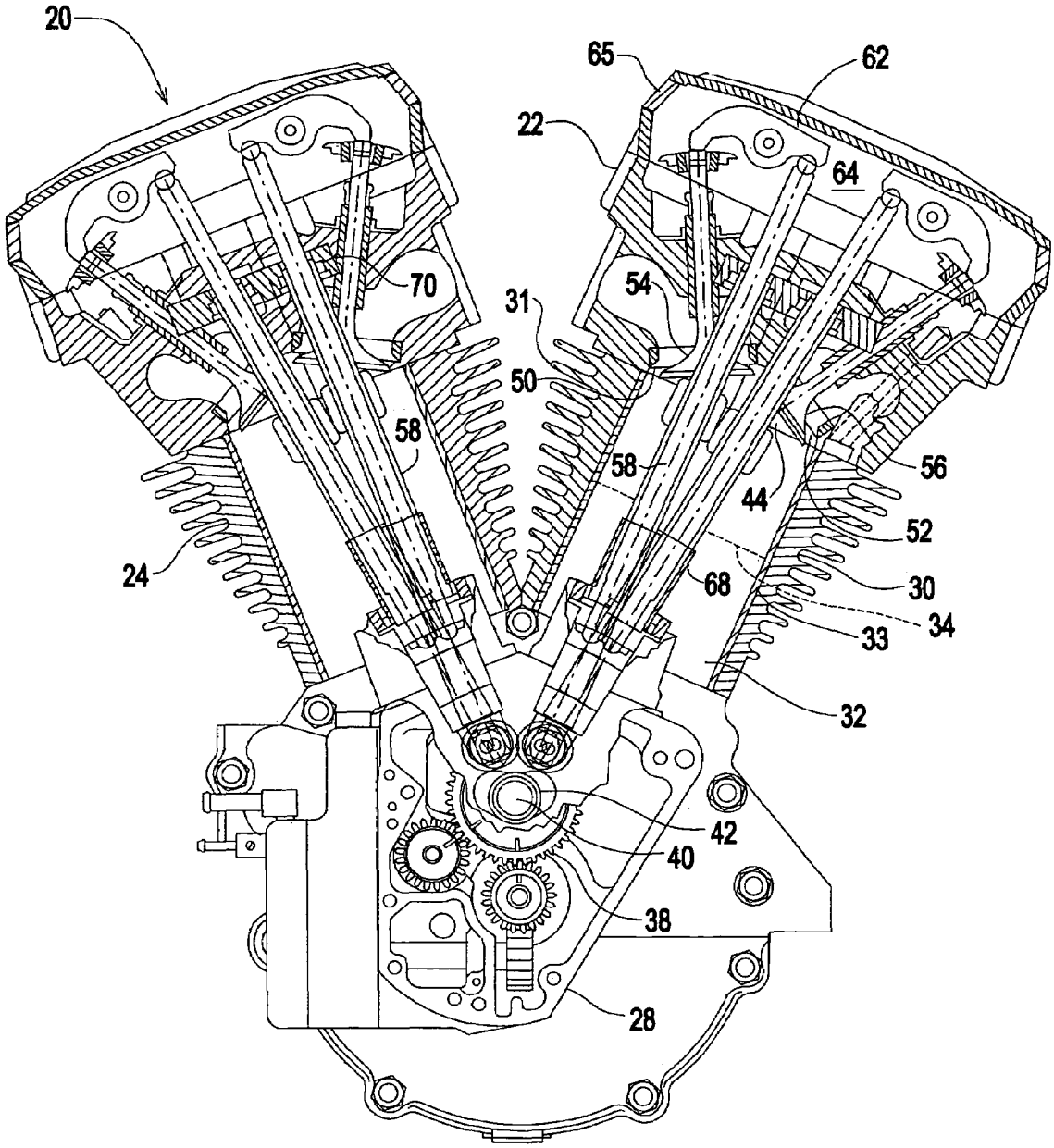
(PRIOR ART) FIG.1
FIG. 1 (prior art) is a side view, in partial cross section, of a V-twin internal combustion engine.
Figure 2:
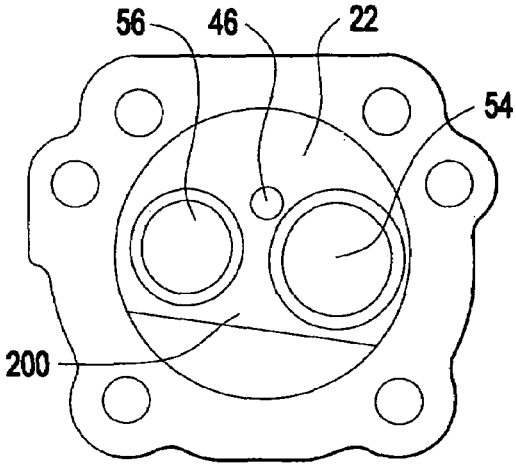
(PRIOR ART) FIG.2
FIG. 2 (prior art) is a bottom plan view of a cylinder head of a V-twin internal combustion engine.
Figure 4:
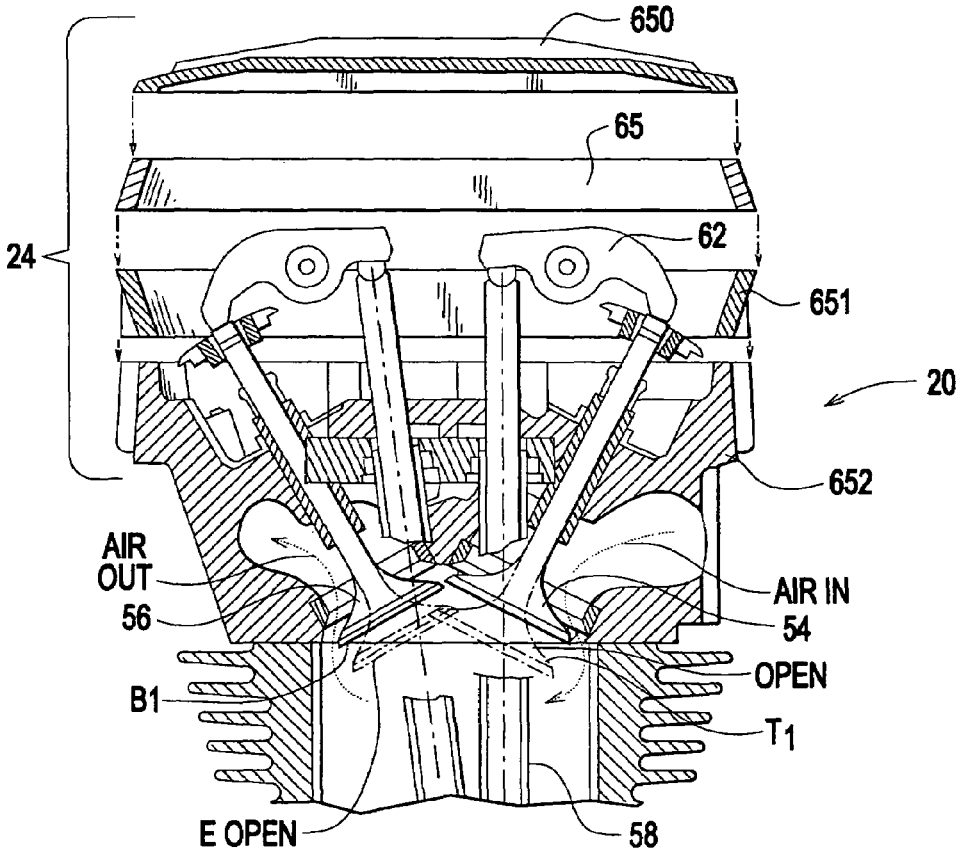
(PRIOR ART) FIG.4
FIG. 4 (prior art) is the same view as FIG. 1 showing air path.

Referring first to FIGS. 1, 2, 4 there is a pushrod housing 68 for the pushrod 58.

FIG. 1 is a side view illustration, in partial cross-section, of a V-twin motorcycle engine 20. The particular engine illustrated is the Stock '84-UP Big Twin motorcycle engine made by S&S Cycle, Inc. of Viola, Wis.

The V-twin motorcycle engine 20 is a two-cylinder engine. The two cylinders 24 and 26 are each attached to, and extend from, a single crank case 28. The two cylinders 24 and 26 are substantially identical, each having identical parts and operating in the same way. Each cylinder 24 and 26 includes a cylinder block 30, mounted to the crank case 28, and a cylinder head 22 mounted to the cylinder block 30. Both the cylinder head 22 and cylinder block 30 have fins 31 integrally formed on the outside thereof for improved air cooling of the engine 20. The cylinder block 30 has a cylinder 32 formed therein. The cylinder 32 is preferably lined with a cylinder sleeve 33. A piston 34 is mounted for reciprocal motion within the cylinder sleeve 33. The piston 34 is connected by a conventional connecting rod mechanism (not shown) to drive a crank shaft (not shown) in the crank case 28. This shaft is connected, e.g., via gears 38 to a cam shaft 40, also mounted in the crank case 28. The cam shaft 40 has one or more cams 42 mounted thereon.

The cylinder head 22 is mounted to the end of the cylinder block 30 opposite the crank case 28. A portion of the bottom surface of the cylinder head 22 is aligned with the cylinder head 22 is aligned with the cylinder 32 in the cylinder block 30 to form a combustion chamber 44. Three openings are provided into the combustion chamber 44 by the cylinder head 22, a spark plug hole (not shown) an intake opening 50, and an exhaust opening 52. The threaded spark plug hole 46 allows a spark plug to be mounted on the cylinder head. The spark electrodes of the spark plug 48 extend into the combustion chamber 44. The intake opening 50 into the combustion chamber 44 allows an air fuel mixture to be admitted into the combustion chamber 44 prior to combustion. As the piston 34 rises in the cylinder 32, the air fuel mixture in the combustion chamber 44 is compressed. The compressed air fuel mixture is ignited by a spark from the spark plug. The resulting combustion in the combustion chamber 44 forcefully drives the piston 34 downward in the cylinder 32. The movement of the piston 34 causes rotation of the cam shaft 40. Following combustion, the piston 34 is once again driven upward in the cylinder 32, forcing the remaining gasses out of the combustion chamber 44 through the exhaust opening 52 in the cylinder head 22.

Opening and closing of the intake 50 and exhaust 52 openings in the cylinder head is controlled by intake 54 and exhaust 56 valves, respectively. The intake 54 and exhaust 56 valves are actuated by the cams 42, which are designed to open the valves 54 and 56 at precisely the correct instant of piston travel, and hold them open long enough to attain the most efficient filling and emptying of the cylinder 32.

Referring next to FIG. 2 the top of the combustion chamber is shown as member 200. The shape of member 200 is known to be either flat or hemispherical.

In FIG. 4 the cast aluminum segments of the cylinder head 24 are labeled as a top 650, a rocker box 65, a spacer 651, and a receiving engine block 652. The rocker arm 62 pushes the valve down as the pushrod 58 rises, and a spring forces the valve up in a known manner.

It can be seen that the intake air passage is "S" shaped as shown by arrow "air in," when the valve 54 is in the intake open position open. Similarly the exhaust air passage is a reverse S shape as shown by arrow "air out," when the valve 56 is in the exhaust open position E open. For the air in mode the air must travel around the valve top T. For the air out mode the air must travel around the valve bottom B.

Figure 3:
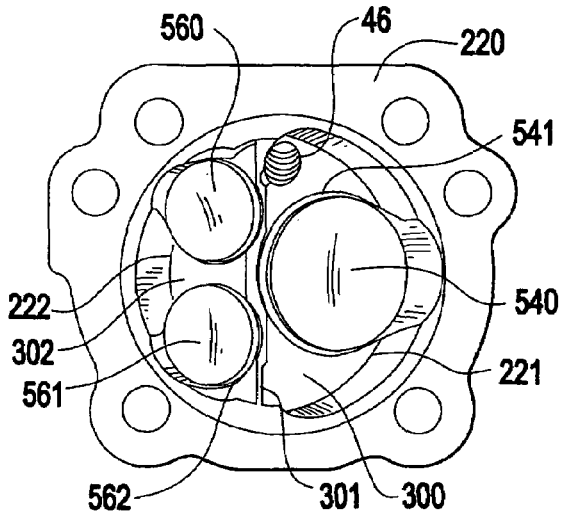
FIG. 3 is a bottom plan view of a cylinder head in accordance with the present invention.

Referring next to FIG. 3 the present invention is shown implemented on the V-twin engine 20 of FIG. 1. Cylinder head 220 is a dual concave shape so as to form a ridge 30/running between the intake valve 540 and the two exhaust valves 560, 561. Intake valve seat 541 is formed in wall 300 which tapers down from the ridge 301 to the edge 221 of the cylinder head. Exhaust valve seat 562 is formed in wall 302 which tapers down from ridge 301 to edge 222 of the cylinder head.

Figure 5B:
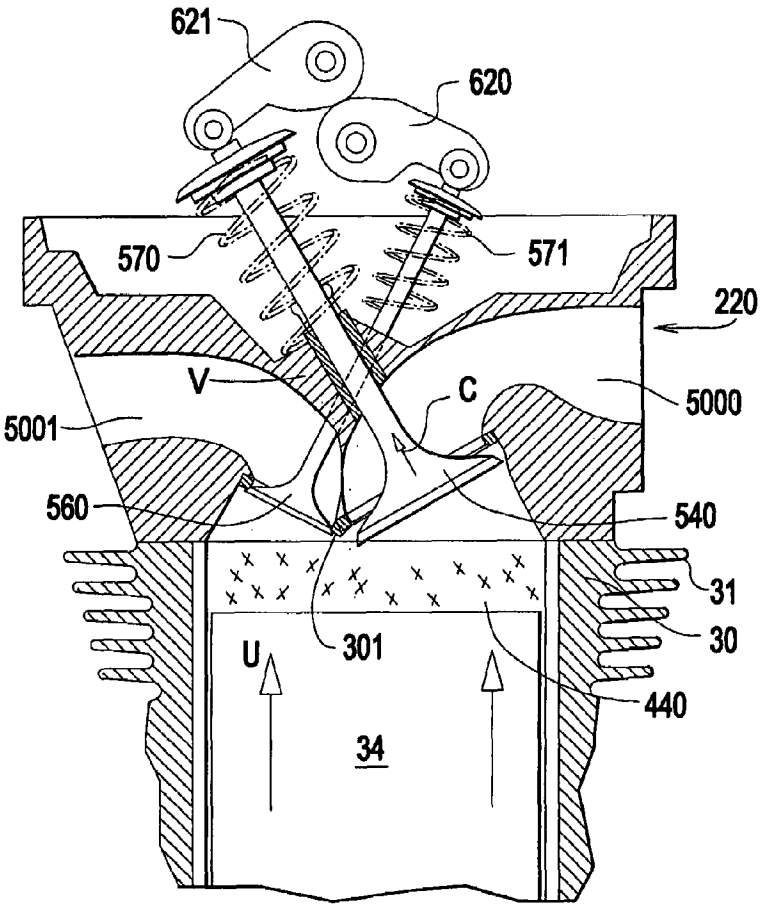
FIG. 5B is the same view as FIG. 5A with the piston in the compression position.
Figure 5A:
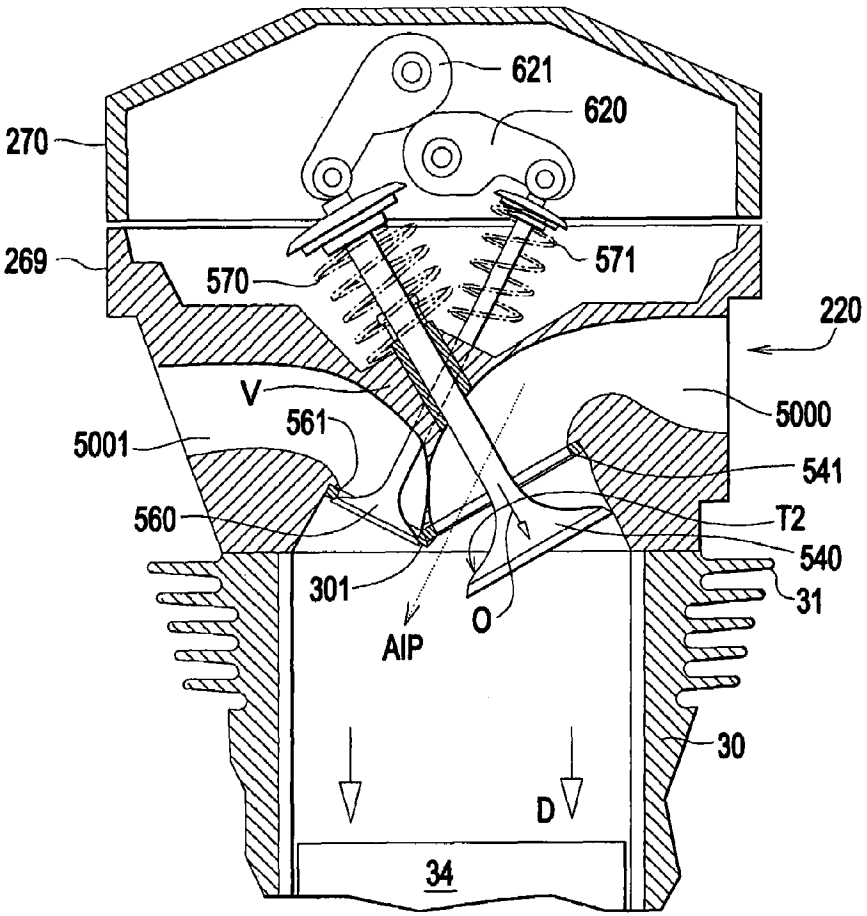
FIG. 5A is a side view, in partial cross section, of the present invention with the piston in the air intake position.

Referring next to FIGS. 5A-5D the cylinder head 220 of FIG. 3 is shown in operation during the cycles of a four stoke engine. Area V is seen as a V shaped depression descending into the combustion chamber, ending in ridge 301. Ridge 301 defines a vertical axis of the combustion chamber. Valves 540, 560, 561 are mounted such that valve bottoms $B_2$ are at an angle to the vertical axis that exceeds 90 degrees. FIG. 5A shows the air intake passage AIP having a portion that is straight and not blocked by the valve top $T_2$ of the intake valve 540, which is shown open by arrow O. The piston 34 is moving in direction down shown by arrow D. Exhaust valve(s) 560, 561 are closed. The intake manifold channel 5000 is formed in the cylinder head 220, and the exhaust manifold channels 5001 are formed in the cylinder head 220.

Rocker arms 620, 621 push the valves 560, 540 down, and springs 570, 571 return the valves to a closed position as shown by arrow C in FIG. 5B.

FIG. 5B shows the piston 34 going up with arrow U, wherein the combustion chamber 440 has a high pressure in it as it is almost ready for firing.

The cover 270 has been removed from the cylinder head block 269.

Figure 5D:
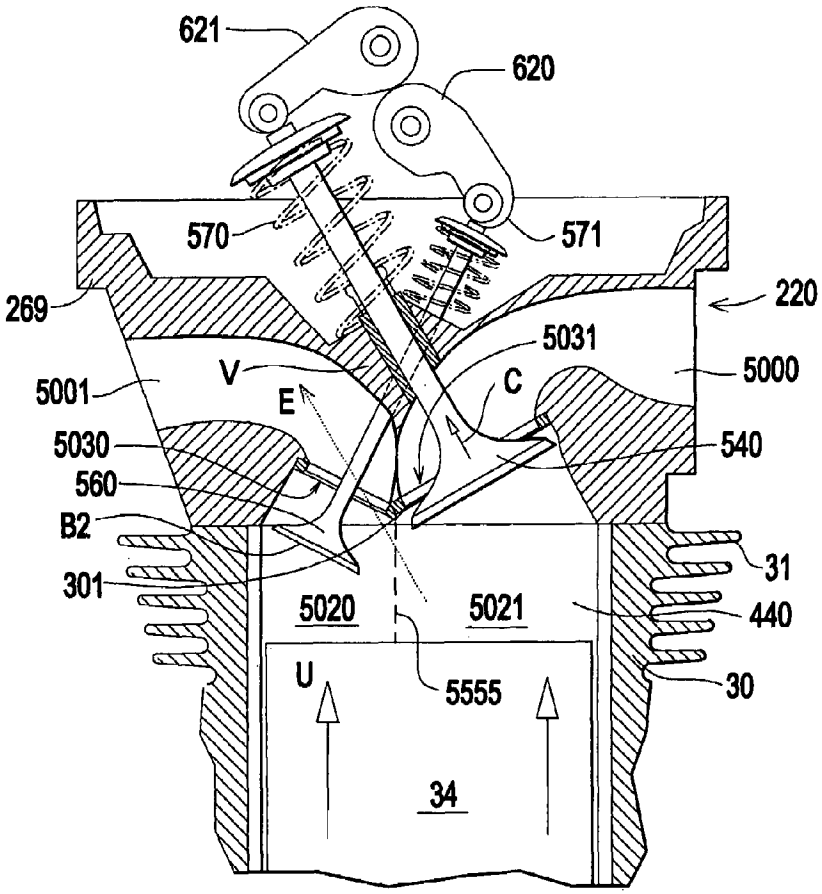
FIG. 5D is the same view as FIG. 5A with the piston in the exhaust position.
Figure 5C:
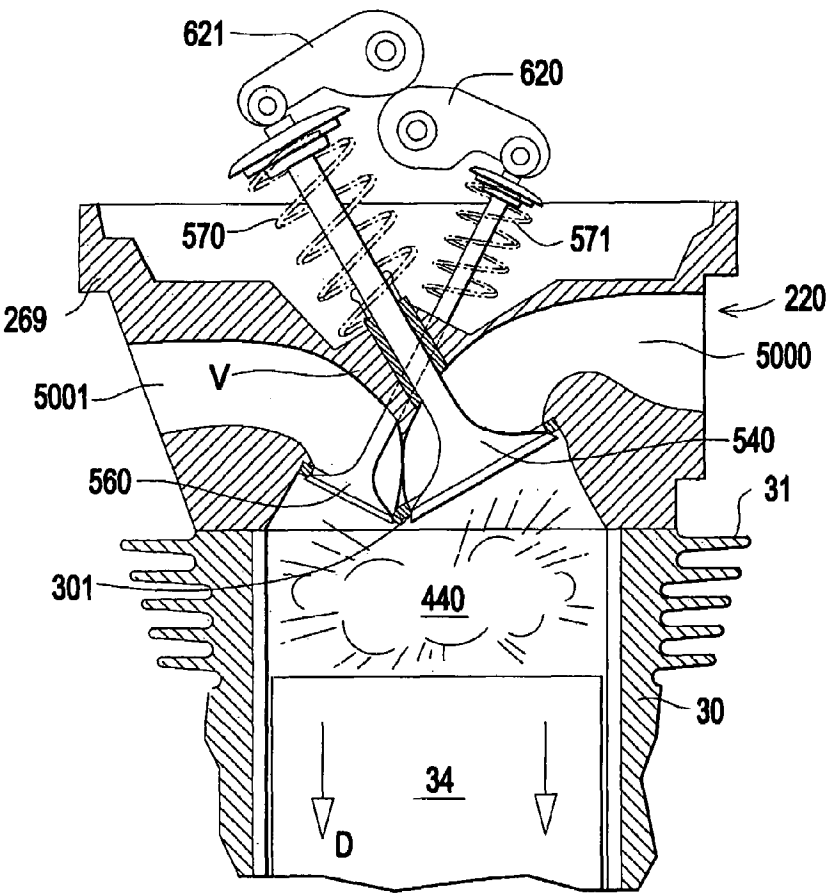
FIG. 5C is the same view as FIG. 5A with the piston in the fired position.

In FIG. 5C the combustion chamber 440 has fired. Valves 540, 560 are closed. Piston 34 starts to move down in direction D.

In FIG. 5D the piston 34 is moving up in direction UP for the exhaust stroke. Valve 560 is open. However, valve 540 is also partly open which is a common design for many engines. Arrow E shows a straight line path for the exhaust air so that at least a portion of the exhaust air can exit the combustion chamber without traveling around valve bottom $B_2$.

The combustion chamber exhaust segment 5020 is separated from the combustion chamber intake segment 5021 by the ridge 301 and dotted line 5555. The ratio of 5021/5020 can range from about 60/40 to 80/20. This separation of gases reduces the waste of pushing unburnt intake air from segment 5021 out the exhaust port 5030. This is known in the art as a reduction of scavenging air. Also, any backflow through port 5031 of intake air from segment 5021 is predominantly unburnt intake air from segment 5021 and not exhaust air from segment 5020. Therefore, only a minimum of exhaust air is pulled in from the intake manifold 5000 in the next intake cycle.

Figure 6:
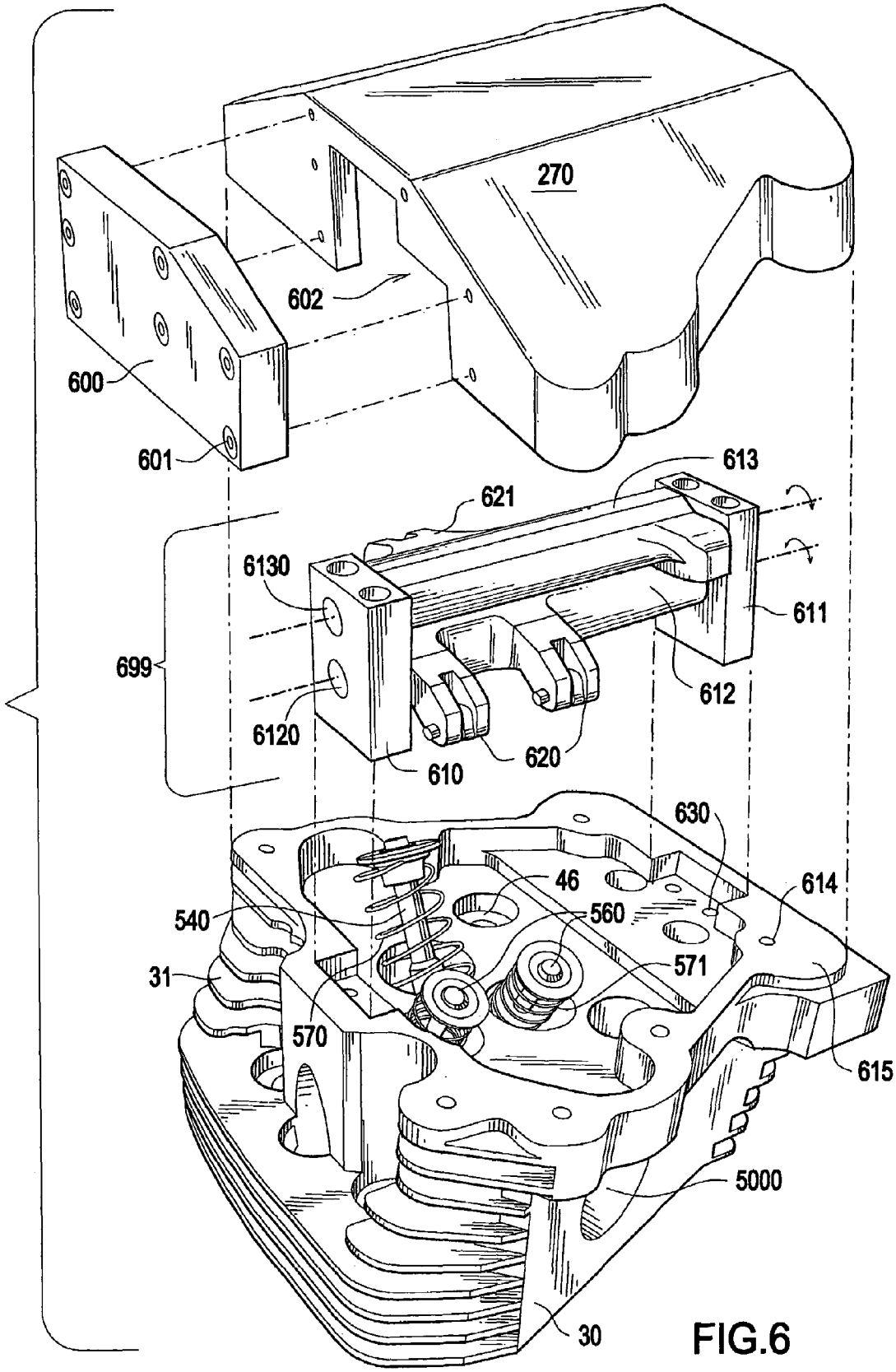
FIG. 6 is an exploded view of the present invention implemented on a V-twin engine.

Referring next to FIG. 6 the two exhaust valve rocker arms 620 are seen as part of a pivotable bracket 612. Pivotable bracket 612 is supported between post 610, 611 which are bolted into the cylinder head 30 via holes 630. The pivot point is shown at 6120. The intake valve rocker arm 621 is part of a pivotable bracket 613. Pivotable bracket 613 is also supported between posts 610, 611. The pivot point is shown at 6130, wherein bracket 612 rests below bracket 613.

Once the rocker assembly 699 is secured to the cylinder head 30, then the one piece rocker top 270 can be slid over the posts 610, 611 as the posts fit through the door 602. The door closure 600 is bolted to the rocker top 270 via holes 601. Then the rockertop 270 is bolted to the cylinder head 30 via holes 614, with a gasket 615 therebetween.

Figure 7:
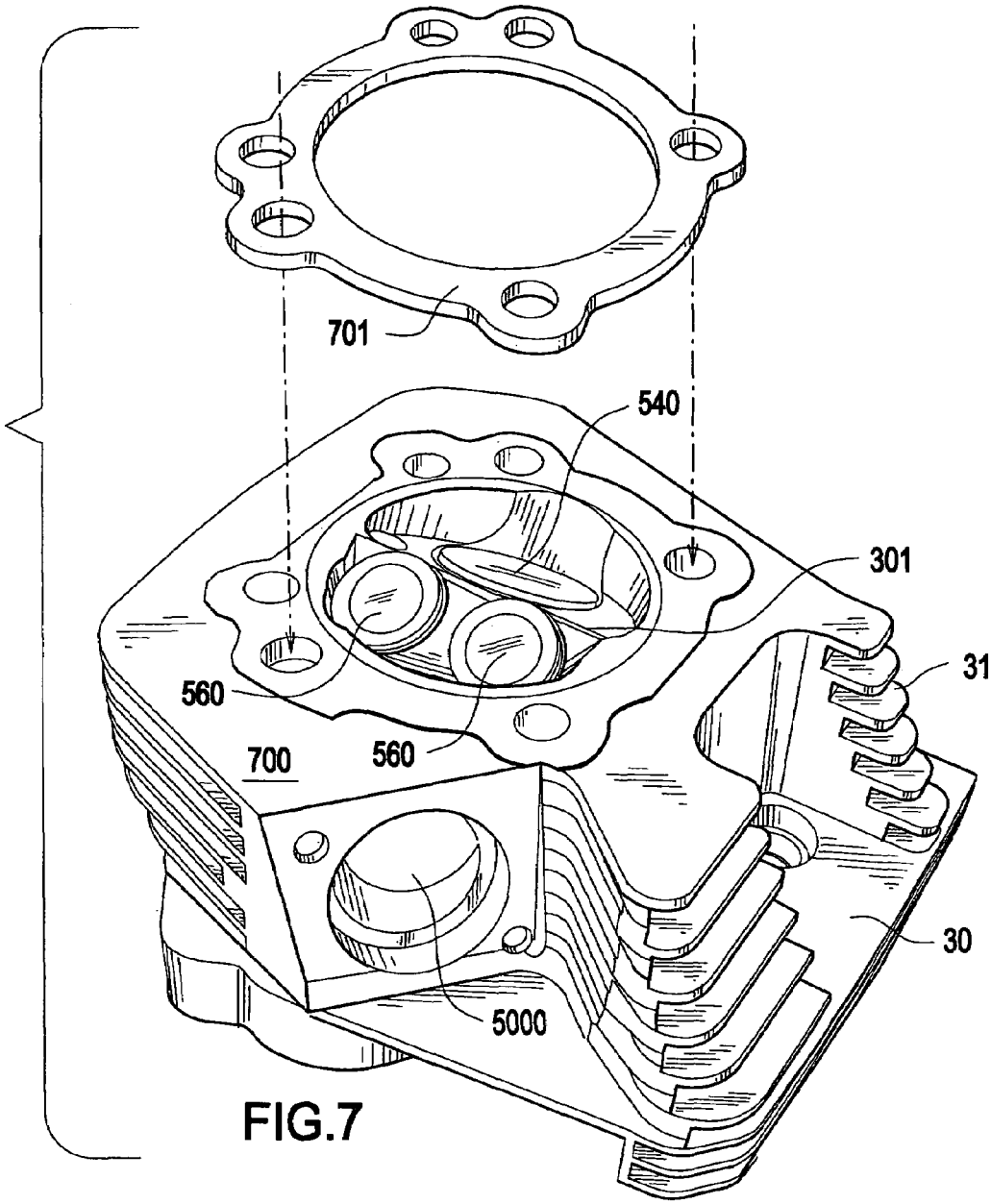
FIG. 7 is a top perspective view of the FIG. 6 embodiment showing a shim.
Figure 8:
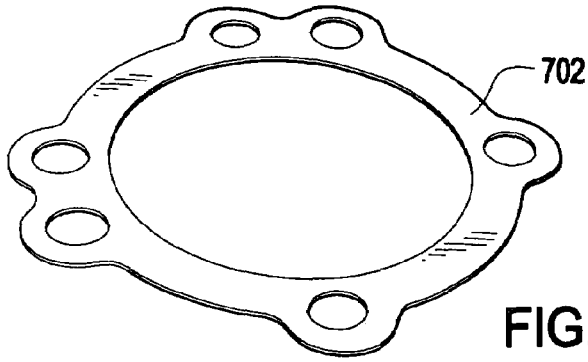
FIG. 8 is a top perspective view of a thinner shim for use in the FIG. 7 embodiment.

Referring next to FIGS. 7, 8 the bottom of cylinder head 30 is labeled 700. The user can select the volume of the combustion chamber by using gaskets of varying thickness wherein gasket 701 is thicker than gasket 702. Typical gasket thickness range from 0.01 to 0.5 in the V-twin shown.

Figure 9:
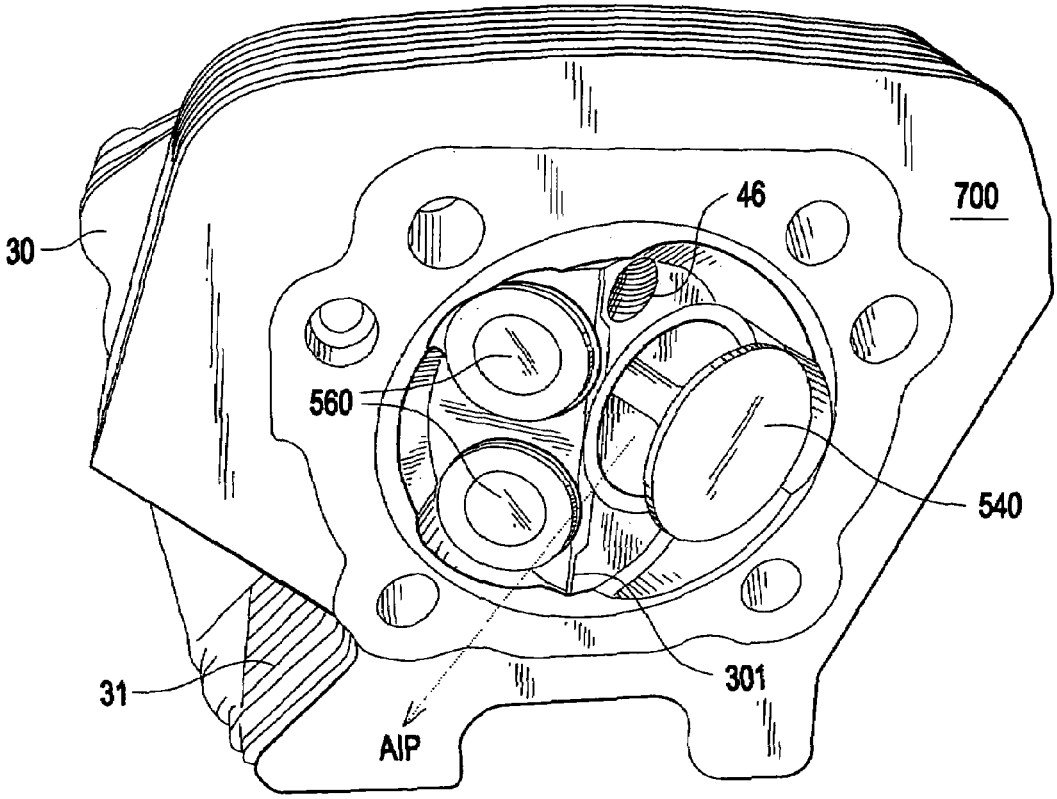
FIG. 9 is a bottom perspective view of the FIG. 6 embodiment with the intake valve open.
Figure 10:
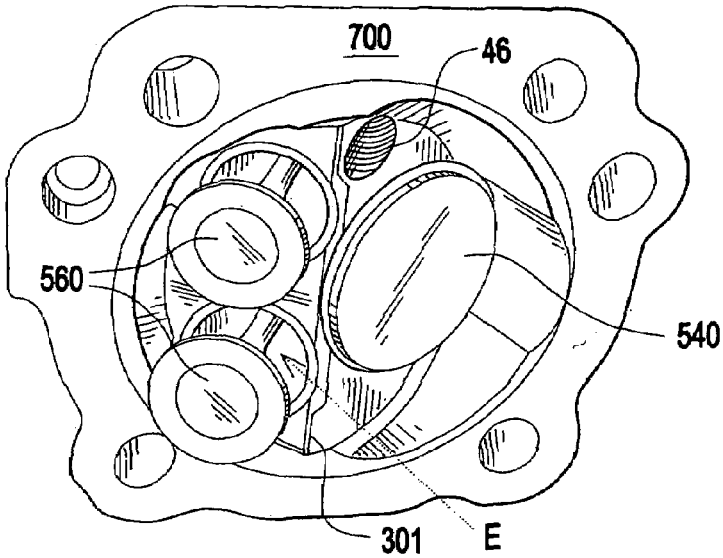
FIG. 10 is the same view as FIG. 9 with the exhaust valves open.

Referring next to FIGS. 9, 10 the straight segment AIP of intake air, and the straight segment E of exhaust air can be seen. In the V-twin embodiment shown a pencil can be placed in the lines AIP and E.

Figure 13:
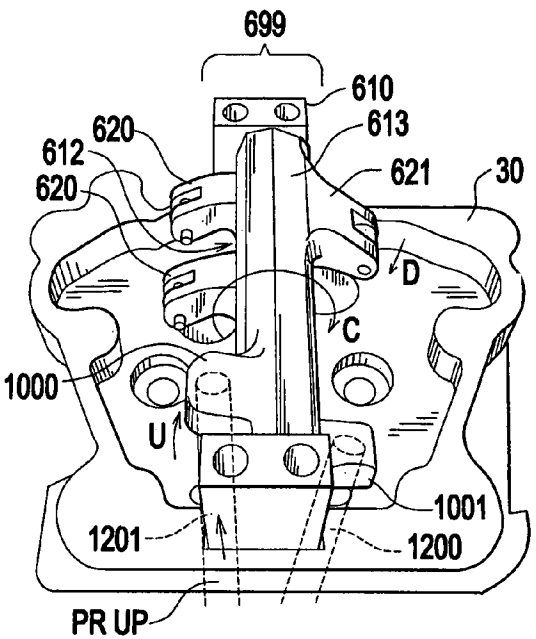
FIG. 13 is the same view as FIG. 11 with the assembly moving toward the intake open direction.
Figure 12:
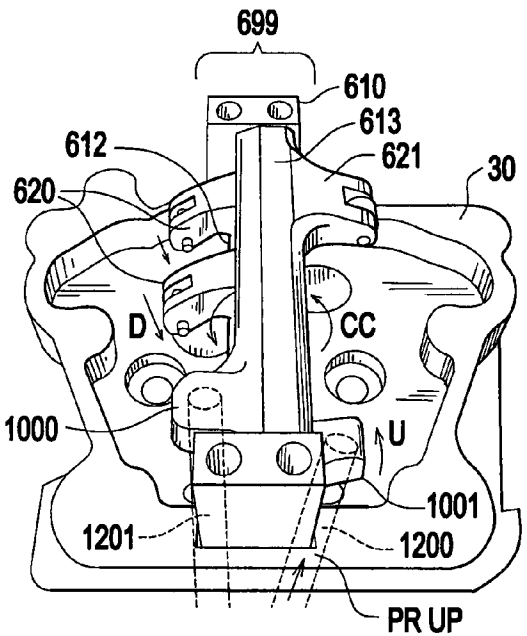
FIG. 12 is the same view as FIG. 11 with the assembly moving toward the intake valve closed direction.
Figure 11:
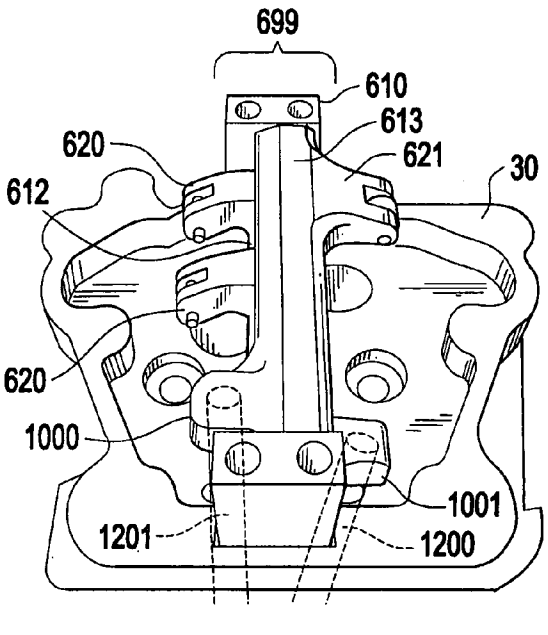
FIG. 11 is a top perspective view of the valve control assembly in a neutral position known as "TDC", top dead center.

Referring next to FIGS. 11, 12, 13 it can be seen that pushrod 1201 pushes up on flange 1000 which is part of pivotable bracket 613. Pushrod 1200 pushes up on flange 1001 which is part of pivotable bracket 612.

In FIG. 11 both pushrods are in a neutral position as in a firing condition. In FIG. 12 pushrod 1200 is moving up PRUP, thereby forcing flange 1001 up U. Pivotable bracket 612 rotates counterclockwise CC, thereby forcing rocker arms 620 down to open the exhaust valves (not shown).

In FIG. 13 pushrod 1201 is moving up PRUP to force flange 1000 up U. Pivotable bracket 613 is rotated clockwise C, thereby forcing rocker arm 621 down to open the intake valve (not shown). The pushrods are forced back down by the valve springs 570, 571 of FIG. 6 as noted above.

Figure 14:
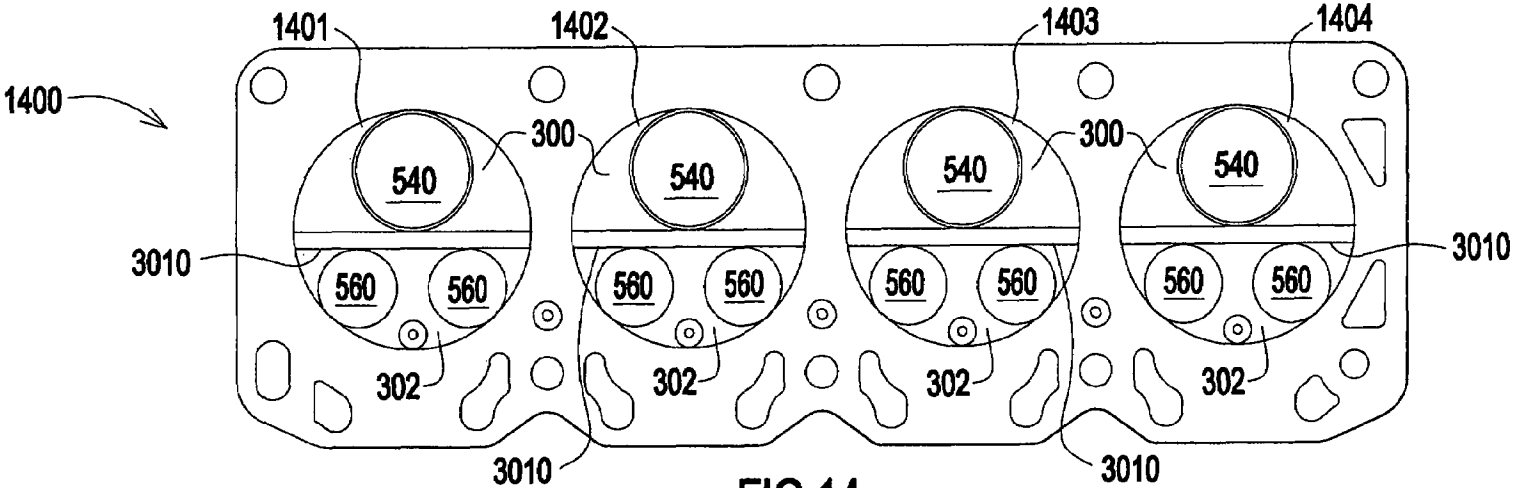
FIG. 14 is a bottom plan view of the present invention executed in a V8 cylinder head.
Figure 15:
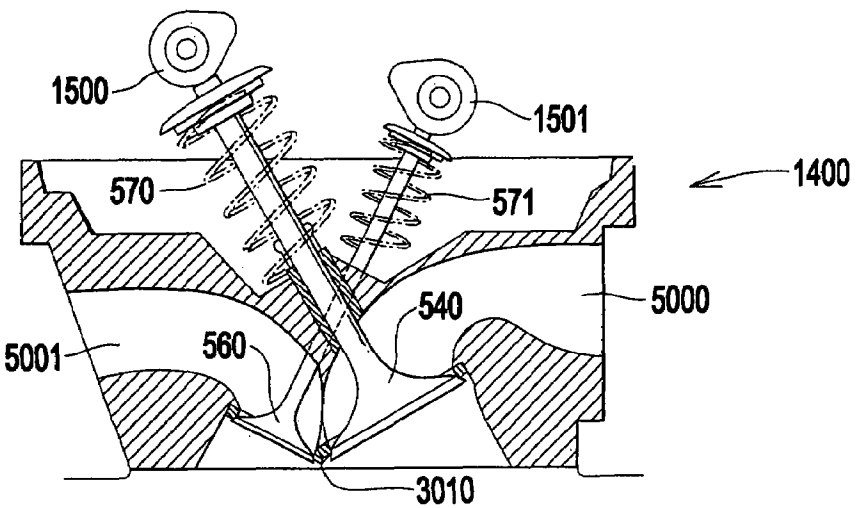
FIG. 15 is a side view, in partial cross section, of the FIG. 14 engine showing the dual overhead cam control for the valves.

Referring next to FIGS. 14, 15 a cylinder head 1400 is shown for a V8 engine incorporating the present invention.

Each combustion chamber top 1401, 1402, 1403, 1404 has the ridge 3010 which descends into the combustion chamber, thereby forming the walls 300, 302 described in FIG. 3 above. The valves 540, 560 are still criss-crossed in order to seat in their respective walls 300, 302. Overhead cams 1500, 1501 operate in a know manner to open/close a row of valves 540, 560 simultaneously. Many equivalent valve control devices can actuate valves 540, 560 including single overhead cam, multiple overhead cams, pushrod assemblies, and electronic devices.

Virtually any type engine such as V6, V4, I4, I6, I8 and opposed cylinders could be adapted to the present invention.

Although the present invention has been described with reference to preferred embodiments, numerous modifications and variations can be made and still the result will come within the scope of the invention. No limitation with respect to the specific embodiments disclosed herein is intended or should be inferred. Each apparatus embodiment described herein has numerous equivalents.

We claim:

1. A cylinder head comprising:

an intake valve wall descending into a combustion chamber;

an exhaust valve wall descending into the combustion chamber;

said valve walls meeting to form a ridge extending downwardly into the combustion chamber, said ridge defining a vertical axis of the combustion chamber;

wherein an intake valve and an exhaust valve criss-cross each other to open/close relative to their respective walls, each of said valves having a valve bottom; and each of said valve bottoms being at an angle to the vertical axis, said angles each being more than 90 degrees, each of said valve bottoms being preponderantly on one or the other side of a vertical plane containing said vertical axis, said vertical pane being aligned with said ridge.

2. The cylinder head of claim 1, wherein the intake valve wall has a slot for one intake valve, and the exhaust valve wall has a slot for each of two exhaust valves.

3. The cylinder head of claim 1 further comprising a rocker arm assembly with a first pivotable bracket in contact with a push rod to open the intake valve, and a second pivotable bracket in contact with a push rod to open the exhaust valve.

4. The cylinder head of claim 3, wherein the first and second pivotable brackets are supported by a pair of posts.

5. The cylinder head of claim 4, wherein the rocker arm assembly further comprises a one piece enclosure cap with an access opening and a shutter therefore.

6. The cylinder head of claim 1 further comprising a spacer to mount the cylinder head to a chosen space above an engine block.

7. The cylinder head of claim 1, wherein the intake valve wall forms a first concave combustion chamber segment, and the exhaust valve wall forms a second concave combustion chamber segment.

8. The cylinder head of claim 7, wherein the first concave combustion chamber segment is larger than the second concave combustion chamber segment.

9. The cylinder head of claim 8, wherein during an exhaust cycle an exhaust air stream is drawn primarily from the second concave combustion chamber segment.

10. A cylinder head comprising:

a V shaped depression descending into a combustion chamber;

a first side of the V shaped depression providing a seat for an intake valve;

a second side of the V providing a seat for an exhaust valve;

wherein a segment of each of the intake air and the exhaust air travels in a straight path to and from the combustion chamber respectively without striking the respective valve; and wherein the intake and the exhaust valves criss-cross each other.

11. The cylinder head of claim 10, wherein the V shaped depression forms a concave intake air segment in the combustion chamber, and forms a concave exhaust air segment in the combustion chamber which is smaller than the intake air segment.

12. The cylinder head of claim 10 further comprising a valve closing assembly means functioning to open and close the valves.

13. The cylinder head of claim 10 further comprising a single intake valve and two exhaust valves.

14. A dual concave head comprising:

an intake valve wall descending into a combustion chamber;

and forming a concave intake cylinder head segment;

an exhaust valve wall descending into a combustion chamber and forming a concave exhaust cylinder head segment;

said valve walls meeting to form a ridge extending downwardly into the combustion chamber, said ridge defining a vertical axis of the combustion chamber;

wherein an intake air segment and an exhaust air segment is formed in the combustion chamber under their respective concave segments;

an intake valve opening and closing against the intake valve wall, and an exhaust valve opening and closing against the exhaust valve wall, and wherein the intake and exhaust valves criss-cross each other in the cylinder head, each of said valves having a valve bottom; and each of said valve bottoms being at an angle to the vertical axis, said angles each being more than 90 degrees each of said valve bottoms being preponderantly on one or the other side of a vertical plane containing said vertical axis, said vertical pane being aligned with said ridge.

15. The cylinder head of claim 14 further comprising a valve control means functioning to open/close the valves.

16. The cylinder head of claim 14, wherein a segment of an intake air steam has a straight path to the combustion chamber.

17. A process to decrease a time of flight of combustion gas through a combustion chamber comprising the steps of:

forming a dual concave cylinder head with a V shaped depression into the combustion chamber;

forming an intake valve seat in a first side of the V shaped depression;

forming an exhaust valve seat in a second side of the V shaped depression; forming a criss-crossed arrangement of an intake and an exhaust valve;

providing a straight path for a segment of intake air into the combustion chamber; and providing a straight path for a segment of exhaust air from the combustion chamber.

* * * * *